US009413128B2

(12) United States Patent
Tien et al.

(10) Patent No.: US 9,413,128 B2
(45) Date of Patent: Aug. 9, 2016

(54) CONNECTOR MODULE HAVING A ROTATING ELEMENT DISPOSED WITHIN AND ROTATABLE RELATIVE TO A CASE

(71) Applicant: HTC Corporation, Taoyuan (TW)

(72) Inventors: Ernest Euan Tien, Taoyuan (TW); Chun Ta Huang, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 0 days.

(21) Appl. No.: 14/656,471

(22) Filed: Mar. 12, 2015

(65) Prior Publication Data

US 2016/0072244 A1 Mar. 10, 2016

Related U.S. Application Data

(60) Provisional application No. 62/045,632, filed on Sep. 4, 2014.

(51) Int. Cl.

| | |
|---|---|
| ***H01R 3/00*** | (2006.01) |
| ***H01R 39/64*** | (2006.01) |
| ***H01R 13/52*** | (2006.01) |
| ***H01R 35/04*** | (2006.01) |

(52) U.S. Cl.

CPC ..... *H01R 39/64* (2013.01); *H01R 13/52* (2013.01); *H01R 35/04* (2013.01)

(58) Field of Classification Search

CPC ..... H01R 24/005; H01R 24/58; H01R 35/02; H01R 35/025; H01R 35/04; H01R 39/00

USPC ..... 439/13–22

See application file for complete search history.

(56) References Cited

U.S. PATENT DOCUMENTS

| | | | | |
|---|---|---|---|---|
| 5,013,224 | A * | 5/1991 | Liao | F04D 25/166 416/100 |
| 5,046,951 | A * | 9/1991 | Suzuki | B60R 16/027 439/15 |
| 5,098,028 | A * | 3/1992 | Ida | B60R 16/027 191/12.2 R |
| 5,655,919 | A * | 8/1997 | Ishikawa | H01R 35/025 439/15 |
| 5,704,792 | A * | 1/1998 | Sobhani | H01R 39/64 439/21 |
| 7,601,005 | B1 * | 10/2009 | Lai | F04D 25/088 439/12 |
| 8,167,633 | B1 * | 5/2012 | Wu | H01R 13/6675 439/164 |
| 8,986,026 | B2 * | 3/2015 | Utsunomiya | H01R 35/04 439/164 |
| 2002/0025705 | A1 * | 2/2002 | Araki | B60R 16/027 439/164 |
| 2007/0184693 | A1 * | 8/2007 | Mitsui | H01R 35/025 439/164 |
| 2009/0317995 | A1 * | 12/2009 | Oishi | B60R 16/027 439/164 |
| 2013/0115785 | A1 * | 5/2013 | Kamiya | B60R 16/027 439/15 |
| 2013/0252442 | A1 * | 9/2013 | Hirai | H01R 35/04 439/16 |

* cited by examiner

*Primary Examiner* — Chandrika Prasad

(74) *Attorney, Agent, or Firm* — Birch, Stewart, Kolasch & Birch, LLP

(57) ABSTRACT

A connector module comprises a casing, a rotating element, a fixing element and a connector. The rotating element is rotatably disposed within the casing. The fixing element is fixedly disposed within the casing. During the fixing element being fixed to the rotating element, the fixing element and the rotating element usually and electrically contact. The connector is disposed on the rotating element and electrically connects with the fixing element through the rotating element.

20 Claims, 4 Drawing Sheets

CONNECTOR MODULE HAVING A ROTATING ELEMENT DISPOSED WITHIN AND ROTATABLE RELATIVE TO A CASE

TECHNICAL FIELD

The disclosure relates in general to a connector module, and more particularly to a connector module capable of performing connection by rotating.

BACKGROUND

Some electronic devices include several electronic modules. These electronic modules are connected to each other and provide a specific function. However, it is possible to make the assembly inconvenient or reliability of electrical connection low after the electronic modules are connected to each other due to the bad design of the connecting mechanisms of these electronic modules. Therefore, how to provide a connecting design capable of promoting assembly and electrical connecting reliability has become a prominent task for the industries.

SUMMARY

The invention is directed to a connector module capable of promoting assemble and reliability of connecting between several modules.

According to one embodiment of the invention, a connecting module is provided. The connecting module includes a case, a rotating element, a fixing element and at least one connector. The rotating element is rotatable with respect to the case and disposed within the case. The fixing element is fixedly disposed within the case, wherein the fixing element and the rotating element maintain electrical contact when the fixing element is rotated with respect to the rotating element. The at least one connector is disposed on the rotating element and electrically connected to the fixing element through the rotating element.

The above and other aspects of the invention will become better understood with regard to the following detailed description of the preferred but non-limiting embodiment (s). The following description is made with reference to the accompanying drawings.

Figure 1A:
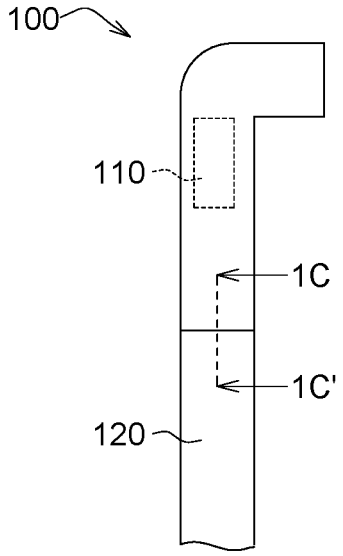
FIG. 1A shows a diagram of an electronic device according to an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Figure 1B:
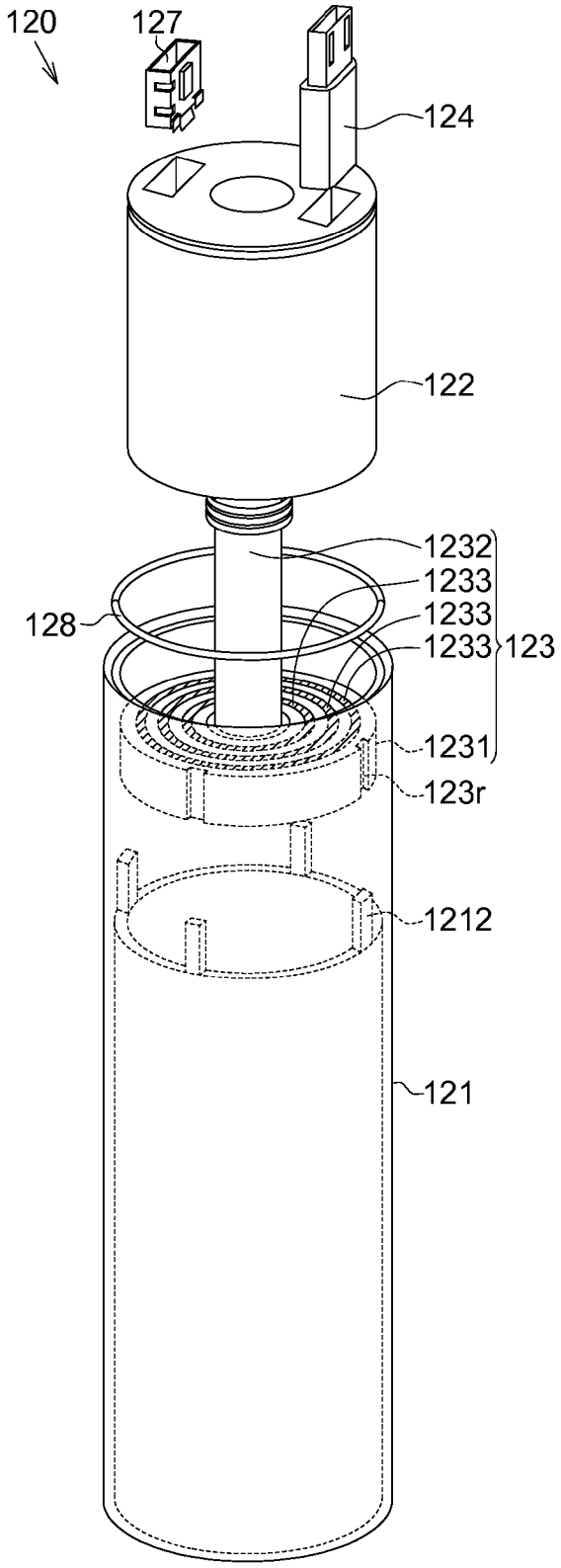
FIG. 1B shows a decomposition view of the connecting module of FIG. 1A.
Figure 1C:
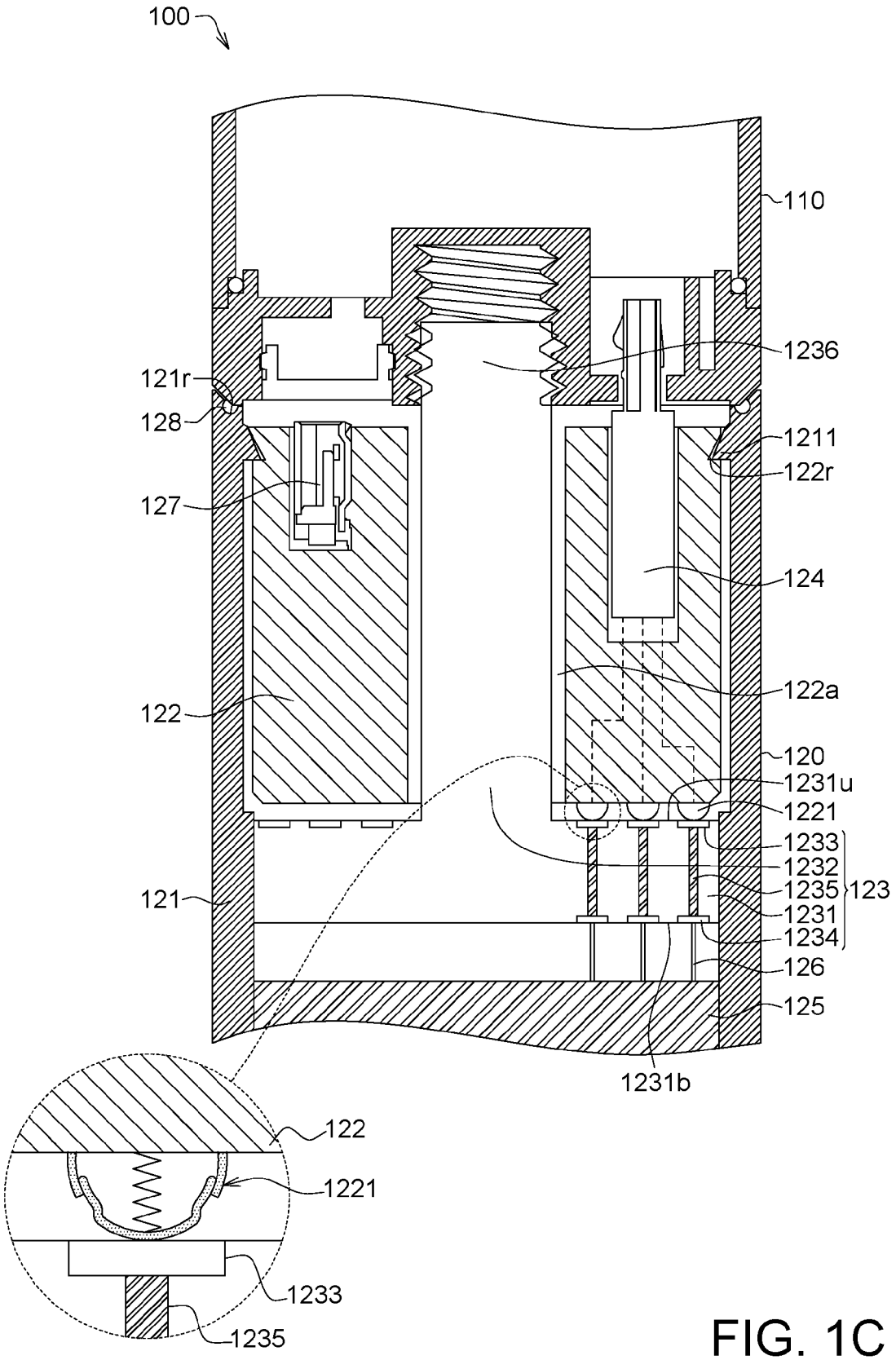
FIG. 1C shows a cross-sectional view of the electronic device of FIG. 1A along a direction 1C-1C'.

Refer to FIGS. 1A to 1C, FIG. 1A shows a diagram of an electronic device according to an embodiment of the invention, FIG. 1B shows a decomposition view of the connecting module of FIG. 1A, and FIG. 1C shows a cross-sectional view of the electronic device of FIG. 1A along a direction 1C-1C'.

The electronic device 100 includes an electronic module 110 and a connecting module 120. The electronic module 110 is, such as, an image capturing module (such as, camera, video, etc.), a communication module (such as, cellphone, etc.) or other electronic module having a circuit. The connecting module 120 of the present embodiment takes a power module capable of providing the electronic module 110 with power, for example. In another embodiment, the connecting module 120 may have circuit (not shown) having a specific function which may match, assist or improve the function of the electronic module 110. For example, the connecting module 120 may be a wireless communication module or a storing module having memory.

As shown FIGS. 1B and 1C, the connecting module 120 includes a case 121, a rotating element 122, a fixing element 123, a first connector 124, an electronic element 125, a conductive wire 126, a second connector 127 and a seal 128. The case 121 includes a block portion 1211, and the rotating element 122 has an engaging recess 122*r*. When the rotating element 122 is disposed within the case 121, the block portion 1211 may be limited to the engaging recess 122*r*, such that the rotating element 122 is blocked by the block portion 1211 and is not easy to be detached from the case 121. In addition, as shown in FIG. 1B, the case 121 includes at least one position-limited portion 1212, and the fixing portion 123 includes at least one position-limited recess 123*r*. The fixing element 123 may be disposed within the case 121 by way of the position-limited recess 123*r* being aligned with the position-limited portion 1212. Since the position-limited portion 1212 is limited to the position-limited recess 123*r*, the fixing element 123 is difficult to rotate with respect to the case 121. In addition, after the fixing element 123 is disposed on the case 121, the position-limited portion 1212 may be adhered to or engaged with the position-limited recess 123*r*, and accordingly the fixing element 123 is prevented from sliding along an axis of the case 121. As a result, the fixing element 123 can't move with respect to the case 121.

In another embodiment, the fixing element 123 may only be limited to the degree of freedom (DOF) of the fixing element 123 rotating with respect to the case 121, but not to the DOF of the fixing element 123 sliding with respect to the case 121.

As shown in FIG. 1C, the rotating element 122 is rotatably disposed within the case 121. The first connector 124 is, for example, various Universal Serial Bus (USB) such as micro USB or USB having other size. The first connector 124 is, for example, a male terminal of USB or a female terminal of USB. The first connector 124 may be inserted into the rotating element 122 and used for connecting to the electronic module 110. After the electronic module 110 is connected to the first connector 124 of the connecting module 120, the electronic module 110 may rotate with respect to the connecting module 120, and accordingly the electronic module 110 and the connecting module 120 may be fixed to each other by way of rotating. Since the fixing element 123 is fixed to the case 121, the fixing element 123 may be fixed to the electronic module 110 during the electronic module 110 rotating with respect to the connecting module 120.

As shown in FIG. 10, the fixing element 123 includes a base 1231, a fixing bar 1232 and a first conductive portion 1233. The fixing bar 1232 of the fixing element 123 is connected to the base 1231 and passes through the through hole 122*a* of the rotating element 122. The fixing bar 1232 includes a fixing end 1236 passing through and projecting from the through hole 122*a*. The fixing end 1236 has a thread which may be screwed to the electronic module 110 for fixing the electronic module 110 and the connecting module 120. In the present embodiment, the fixing end 1236 has a male thread, and the electronic module 110 has a matching female thread. In another embodiment, the fixing end 1236 has a female thread, and the electronic module 110 has a matching male thread. In addition, the thread of the fixing end 1236 may be realized by standard specification, such as a standard thread with a diameter of 0.25 inches.

The first conductive portion 1233 is disposed on the base 1231 and exposed from an upper surface 1231*u* of the base 1231. The rotating element 122 further includes a second conductive portion 1221. The second conductive portion 1221 contacts with the first conductive portion 1233 for being electrically connected to the first conductive portion 1233. As a result, the electronic module 110 may be electrically connected to the electronic element 125 through the first connector 124, the first conductive portion 1233 and the second conductive portion 1221.

In the present embodiment, the first conductive portion 1233 is closed ring-shaped, such that the second conductive portion 1221 and the first conductive portion 1233 maintain electrical contact when the electronic module 110 is rotated with respect to the connecting module 120. In the present embodiment, the electronic element 125 is, for example, a battery. Since the second conductive portion 1221 and the first conductive portion 1233 maintain electrical contact, the electronic module 110 is powered by the electronic element 125 through the second conductive portion 1221, the first conductive portion 1233 and the first connector 124. In addition, the second connector 127 may receive an exterior power. For example, the electronic element 125 may be charged by an exterior power supply (not shown) through the second connector 127. The type of the second connector 127 may be similar to that of the first connector 124. The second connector 127 is, for example, a female terminal of USB or a male terminal of USB. In another embodiment, the second connector 127 may be omitted response to the design of the electronic element 125 or the connecting module 120.

In addition, since the second conductive portion 1221 and the first conductive portion 1233 maintain electrical contact, the electrical connection between the rotating element 122 and the fixing element 123 may be not affected by a rotating angle between the electronic module 110 and the connecting module 120. That is, once the electronic module 110 and the connecting module 120 are fixed, the electronic module 110 may be electrically connected to the connecting module 120 regardless of the relative position between the electronic module 110 and the connecting module 120. As a result, the electrical reliability of the electronic module 110 and the connecting module 120 may be increased.

In the present embodiment, the second conductive portion 1221 is an elastic connector, such as a pogo pin. The second conductive portion 1221 may press against the first conductive portion 1233 through an elastic force for maintaining electrical contact with the first conductive portion 1233. In another embodiment, the first conductive portion 1233 may be an elastic connector and the first conductive portion 1233 may be closed ring-shaped.

In addition, the number of the first conductive portion 1233 and/or the number of the second conductive portion 1221 may be single or several, and/or the number of the first conductive portion 1233 may be equal to or different form the number of the second conductive portion 1221. The number of the first conductive portion 1233 and/or the number of the second conductive portion 1221 may depend on the design of the first connector 124 or the electronic element 125, and such exemplification is not meant to be for limiting.

The fixing element 123 further includes a pad 1234 and a conductive via 1235, wherein the pad 1234 is formed on the base 1231 and exposed from a lower surface 1231*b* of the base 1231. The conductive via 1235 is formed within the base 1231 and electrically connects the pad 1234 and the first conductive portion 1233, such that the first conductive portion 1233 is electrically connected to the electronic element 125 through the conductive via 1235 and the pad 1234. In one embodiment, the base 1231, the first conductive portion 1233, the second conductive portion 1221, the pad 1234 and the conductive via 1235 may be formed as a circuit board which may further include the circuit matching the electronic module 110 and/or the connecting module 120. In addition, the conductive wire 126 connects the fixing element 123 and the electronic element 125. For example, the conductive wire 126 connects the pad 1234 and the electronic element 125 for electrically connecting the fixing element 123 and the electronic element 125.

Of the manufacturing process, the fixing bar 1232 and the base 1231 may be integrated into one piece. For example, the fixing bar 1232 and the base 1231 may be formed by injection molding. After the base 1231 is completed, the first conductive portion 1233, the pad 1234 and the conductive via 1235 may be formed on the base 1231 by the semiconductor manufacturing process. In another embodiment, the fixing bar 1232 and the base 1231 may be formed separately and then combined by using a temporary way or a permanent way, wherein the temporary way is such as engaging, screwing, and the permanent way is such as adhering, welding or riveting. In terms of the material, the base 1231 may be made of a material including high polymer or other insulation material, and the fixing bar 1232 may be made of a material including high polymer, metal, other conductive material or other insulation material. In addition, the base 1231 and the fixing bar 1232 may be made of the same material or different materials. Of different materials, the base 1231 may be made of high polymer, and the fixing bar 1232 may be made of metal.

As shown in FIG. 1C, the case 121 has an indentation 121*r*, and the seal 128 is disposed within the indentation 121*r*. When the electronic module 110 and the connecting module 120 are fixed, the seal 128 is compressed between the case 121 and the electronic module 110, and accordingly the exterior Impurity (such as, liquid or particle) may be prevented from invading the interior of the electronic device 100.

Figure 2:
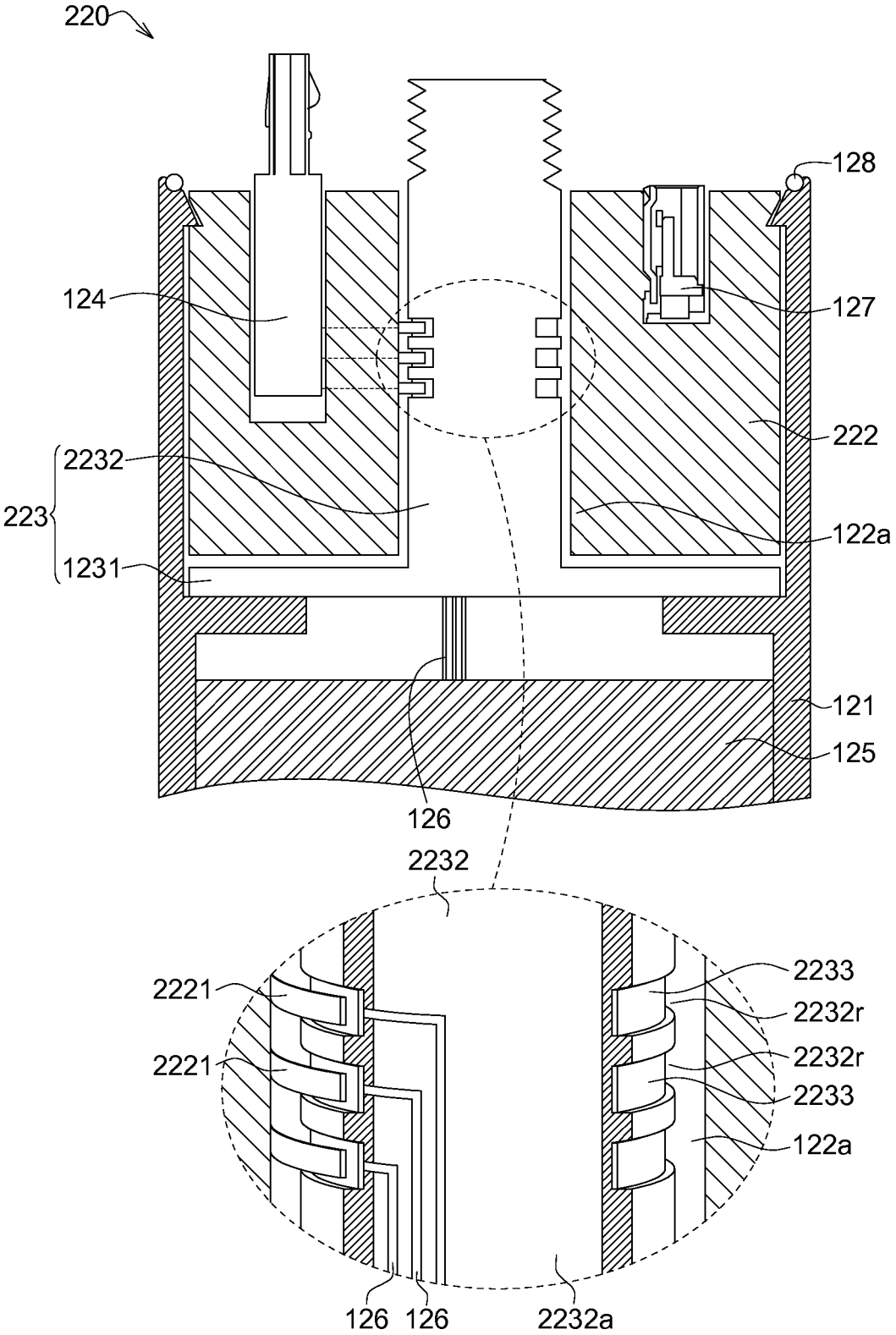
FIG. 2 shows a cross-sectional view of a connecting module according to an embodiment of the invention.

FIG. 2 shows a cross-sectional view of a connecting module according to an embodiment of the invention, wherein an enlargement view of FIG. 2 is the enlargement view of the local portion of the connecting module 220. The connecting module 220 includes the case 121, a rotating element 222, a fixing element 223, the first connector 124, the electronic element 125, the conductive wire 126, the second connector 127 and the seal 128.

The fixing element 223 includes the base 1231, a fixing bar 2232 and a first conductive portion 2233, wherein the base 1231 is fixed to the case 121, and the fixing bar 1232 is connected to the base 1231 and passes through the through hole 122*a* of the rotating element 122. After the electronic module 110 (as shown in FIG. 1B) is connected to the first connector 124 of the connecting module 220, the electronic module 110 may be rotated with respect to the connecting module 220. Since the fixing element 223 is fixed with respect to the case 121, the fixing element 223 may be fixed to the electronic module 110 during the electronic module 110 rotating with respect to the connecting module 220.

As shown in the enlargement view of the local portion of FIG. 2, the first conductive portion 2233 is disposed on an outer sidewall of the fixing bar 2232. The rotating element 222 includes a second conductive portion 2221 disposed on the through hole 122*a* of the rotating element 222 and contacting with the corresponding first conductive portion 2233. In the present embodiment, the first conductive portion 2233 is closed ring-shaped, such that the first conductive portion 2233 and the second conductive portion 2221 maintain electrical contact when the electronic module 110 is rotated with respect to the connecting module 220.

The fixing bar 2232 has a ring-shaped recess 2232*r*, and the first conductive portion 2233 may be accommodated within the ring-shaped recess 2232*r*. As a result, the first conductive portion 2233 may be prevented from excessively projecting and being interfered with an inner sidewall of the through hole 122*a*. The number of the first conductive portion 2233 may be several, and the number of the ring-shaped recess 2232*r* may be equal to that of the first conductive portion 2233 for accommodating all first conductive portions 2233. The number of the first conductive portion 2233 may depend on the design of the first connector 124 and/or the electronic element 125, and such exemplification is not meant to be for limiting.

In the present embodiment, the second conductive portion 2221 is, for example, an elastic piece or an elastic connector, wherein the elastic connector may be similar to the second conductive portion 1221 or other suitable connector. The second conductive portion 2221 may press against the first conductive portion 2233 by the elastic force, such that the second conductive portion 2221 and the first conductive portion 2222 maintain electrical contact when the electronic module 110 is rotated with respect to the connecting module 220.

In addition, the fixing bar 2232 has a hollow portion 2232*a*, the conductive wire 126 extends to the exterior of the fixing element 223 through the hollow portion 2232*a* and connects to the electronic element 125. As a result, the first connector 124 may be electrically connected to the electronic element 125 through the second conductive portion 2221, the first conductive portion 2233 and the conductive wire 126. In the present embodiment, the number of the conductive wire 126 may be equal to that of the first conductive portion 2233, wherein each conductive wire 126 is connected to the corresponding first conductive portion 2233.

To summarize, the connecting module and the electronic device using the same disclosed in above embodiments of the invention at least provide have following effects:

(1). In an embodiment, the rotating element of the connecting module may rotate with respect to the case, such that the electronic module may rotate with respect to the connecting module and is capable of being fixed to the fixing element after the electronic module is connected to the connector inserted into the rotating element.

(2). In an embodiment, one of the first conductive portion and the second conductive portion is closed ring-shaped, such that the first conductive portion and the second conductive portion maintain electrical contact when the electronic module is rotated with respect to the connecting module.

(3). In an embodiment, since the second conductive portion and the first conductive portion maintain electrical contact, the electrical connection between the rotating element and the fixing element may be not affected by the rotating angle between the electronic module and the connecting module.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A connecting module, comprising:

a case;

a rotating element, being rotatable with respect to the case and disposed within the case;

a fixing element fixedly disposed within the case, wherein the fixing element and the rotating element maintain electrical contact when the fixing element is rotated with respect to the rotating element; and at least one connector disposed on the rotating element and electrically connected to the fixing element through the rotating element.

2. The connecting module according to claim 1, wherein the fixing element further comprises:

a base; and a fixing bar connecting with the base and passing through the rotating element.

3. The connecting module according to claim 2, wherein the fixing element further comprises a first conductive portion disposed on the base, and the rotating element comprises a second conductive portion contacting with the first conductive portion.

4. The connecting module according to claim 2, wherein the fixing element further comprises a first conductive portion disposed on the fixing bar, and the rotating element comprises a through hole and a second conductive portion disposed within the through hole and contacting with the first conductive portion.

5. The connecting module according to claim 3, wherein one of the first conductive portion and the second conductive portion is ring-shaped, and another of the first conductive portion and the second conductive portion is an elastic connector.

6. The connecting module according to claim 5, wherein the elastic connector is pogo pin.

7. The connecting module according to claim 4, wherein one of the first conductive portion and the second conductive portion is ring-shaped, and another of the first conductive portion and the second conductive portion is an elastic connector.

8. The connecting module according to claim 7, wherein the elastic connector is pogo pin.

9. The connecting module according to claim 4, wherein the fixing bar has a ring-shaped recess, and the first conductive portion is disposed within the ring-shaped recess.

10. The connecting module according to claim 4, wherein the fixing bar has a hollow portion, and the connecting module further comprises:

a conductive wire extending to an exterior of the fixing element from the first conductive portion through the hollow portion.

11. The connecting module according to claim 2, wherein the fixing bar and the base are integrated into one piece.

12. The connecting module according to claim 2, wherein the rotating element has a through hole and a fixing end of the fixing bar passes through and projects from the through hole.

13. The connecting module according to claim 12, wherein the fixing end has a thread.

14. The connecting module according to claim 1, wherein the case comprises a block portion, the rotating element has an engaging recess, and the block portion is limited to the engaging recess.

15. The connecting module according to claim 1, further comprises:

an electronic component disposed within the case and electrically connected to the fixing element.

16. The connecting module according to claim 15, wherein the electronic component is a battery.

17. The connecting module according to claim 1, wherein the case has an indentation, and the connecting module further comprises:

a seal disposed within the indentation.

18. The connecting module according to claim 1, wherein the at least one connector comprises a first connector and a second connector, the second connector is used for receiving an exterior power, and an interior power is outputted to an electronic module through the first connector.

19. The connecting module according to claim 18, wherein the electronic module is an image capturing module or a communication module.

20. The connecting module according to claim 1, wherein the at least one connector comprises a first connector and a second connector, and the first connector and the second connector are a male connector and a female connector respectively.

* * * * *